United States Patent [19]

Prina

[11] Patent Number: 5,027,728

[45] Date of Patent: Jul. 2, 1991

[54] CHAINING-OFF DEVICE FOR MULTIPLE NEEDLE CHAINSTITCH SEWING MACHINES

[75] Inventor: Raffaele Prina, Milan, Italy

[73] Assignee: Union Special G.m.b.H., Stuttgart, Fed. Rep. of Germany

[21] Appl. No.: 527,611

[22] Filed: May 23, 1990

[30] Foreign Application Priority Data

Jun. 7, 1989 [DE] Fed. Rep. of Germany ..... 3918572

[51] Int. Cl.[5] ..... D05B 1/10; D05B 61/00

[52] U.S. Cl. ..... 112/197; 112/165; 112/260; 112/154

[58] Field of Search ..... 112/165, 197, 260, 154, 112/200

[56] References Cited

U.S. PATENT DOCUMENTS

| | | | |
|---|---|---|---|
| 1,134,483 | 4/1915 | Osterhout | 112/197 |
| 2,740,366 | 4/1956 | Scott | 112/200 |
| 4,175,500 | 11/1979 | Radice et al. | 112/260 |
| 4,186,676 | 2/1980 | Villa et al. | 112/165 |
| 4,220,102 | 9/1980 | Draghiccio et al. | 112/200 |
| 4,430,878 | 2/1984 | Dispennett et al. | 112/260 |
| 4,480,562 | 11/1984 | Von Hagen et al. | 112/165 |
| 4,690,080 | 9/1987 | Mikuni et al. | 112/200 |
| 4,831,947 | 5/1989 | Haisch | 112/165 |
| 4,917,032 | 4/1990 | Matsumoto | 112/197 |
| 4,969,409 | 11/1990 | Nakano | 112/260 |

FOREIGN PATENT DOCUMENTS 0349129 3/1990 European Pat. Off. .

*Primary Examiner*—Werner H. Schroeder
*Assistant Examiner*—Suzlivan C. Prak
*Attorney, Agent, or Firm*—Morgan & Finnegan

[57] ABSTRACT

A device for forming a thread chain on a multiple-needle chainstitch sewing machine having at least two sewing needles, a looper, a needle plate having at least two needle hole slots and a stitch formation tongue disposed between the needle hole slots, and a feed device comprising a feed dog and a presser foot, and a sewing thread brake device disposed beneath the stitch formation tongue beyond the sewing needles in the direction of sewing. The device brakes the sewing threads, and deflects them in such a way that a thread chain is formed.

4 Claims, 3 Drawing Sheets

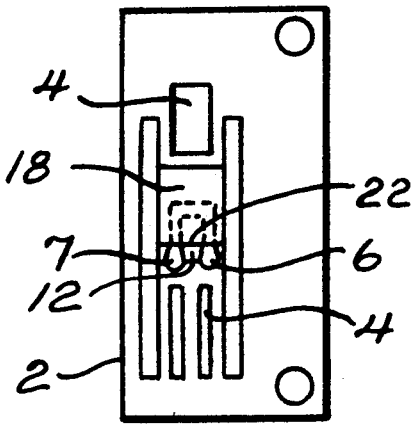
FIG. 3
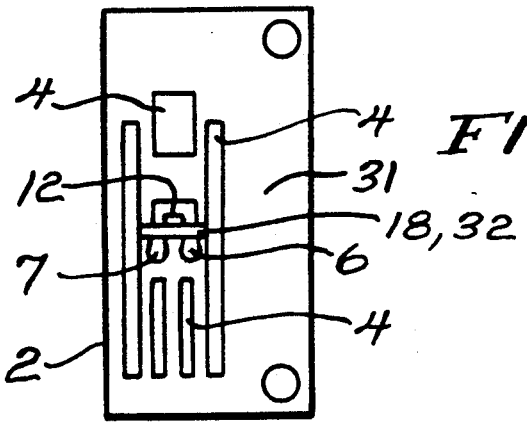
FIG. 4
FIG. 5
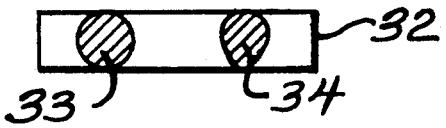

CHAINING-OFF DEVICE FOR MULTIPLE NEEDLE CHAINSTITCH SEWING MACHINES

BACKGROUND OF THE INVENTION

The present invention relates to devices for forming a thread chain on a multiple-needle chainstitch sewing machine.

In two-needle overedge sewing machines, German Patent Specification No. 37 05 263 discloses an overedge stitch of stitch type 506 of Class 500 in accordance with INTERNATIONAL STANDARD ISO ⅓ 4915-1981 (E/F) or German Standard DIN 61400, Duetsches Institut fuer Normung e.V. (German Standardisation Institute), May 1988 Edition, following the formation of a sewing seam on a workpiece with the aid of a chainstitch forming tongue disposed on the side adjacent to a needle hole, to form not only a sewing seam on the workpiece, but also a thread chain without a workpiece. This thread chain, which is formed by a plurality of sewing stitches, makes it possible for a problem-free commencement of the seam to be formed on the edge of a further workpiece to be sewn.

With conventional needle plates in multiple-needle chainstitch sewing machines for a Class 400 double chain stitch, e.g., stitch type 406 or 407, and/or for a double chain stitch having a Class 600 cover thread, for example stitch type 602, 605, in accordance with the above-mentioned standards, it is not possible to form, with sufficient reliability, a thread chain having a plurality of stitches without a workpiece, since, because of the missing workpiece, the sewing threads are positioned irregularly and incorrectly in the stitch formation region.

SUMMARY OF THE INVENTION

A principal feature of the present invention is the provision of an improved device for forming a thread chain on a multiple-needle chainstitch sewing machine.

The device of the present invention comprises, at least two sewing needles, a looper, a needle plate having at least two needle hole slots and a stitch formation tongue disposed between the needle hole slots, a feed device having a feed dog, a holding down device, and a thread brake device disposed below the stitch formation tongue beyond the sewing needles in the direction of sewing.

A feature of the invention is that the device permits exact formation of a thread chain without a workpiece.

Another feature of the invention is that flat workpieces with a thread chain between the workpiece parts can be sewn with a problem-free commencement of the seam on the workpiece, such as stitch types 406, 407 or further multiple-needle chain stitch types from Class 400 and/or 600 of the above-mention standards.

Yet another feature of the invention is that the thread brake device is disposed underneath the stitch formation tongue beyond the sewing needles in the direction of sewing such that the sewing threads are positioned and braked in such a way that they permit the formation of a thread chain, also called a free chain.

A further feature of the invention is that the brake device serves as a substitute for the missing workpiece in which the sewing threads are normally bound.

Thus, a feature of the invention is that perfect stitch formation is made possible.

Another feature of the invention is that the brake device permits the sewing of a plurality of workpiece parts with a long free thread chain between the workpiece parts in such a way that a problem-free commencement of the seam can be formed, such as on sleeve flanks for T-shirts which have a workpiece hem, the seam being according to stitch type 406, 605, or stitch types from a similar class.

Further features will become more fully apparent in the following description of the embodiments of the present invention and from the appended claims.

DESCRIPTION OF THE DRAWINGS

In the drawings:

FIG. 3 is a lower plan view showing a needle plate for the device of FIG. 1;

FIG. 4 is a lower plan view of another embodiment of the needle plate for the device of FIG. 1 and FIG. 5 is an elevational view of a cross pin of the needle plate of FIG. 4 showing two embodiments of the cross section of the cross pin.

DESCRIPTION OF THE PREFERRED EMBODIMENTS

Figure 1:
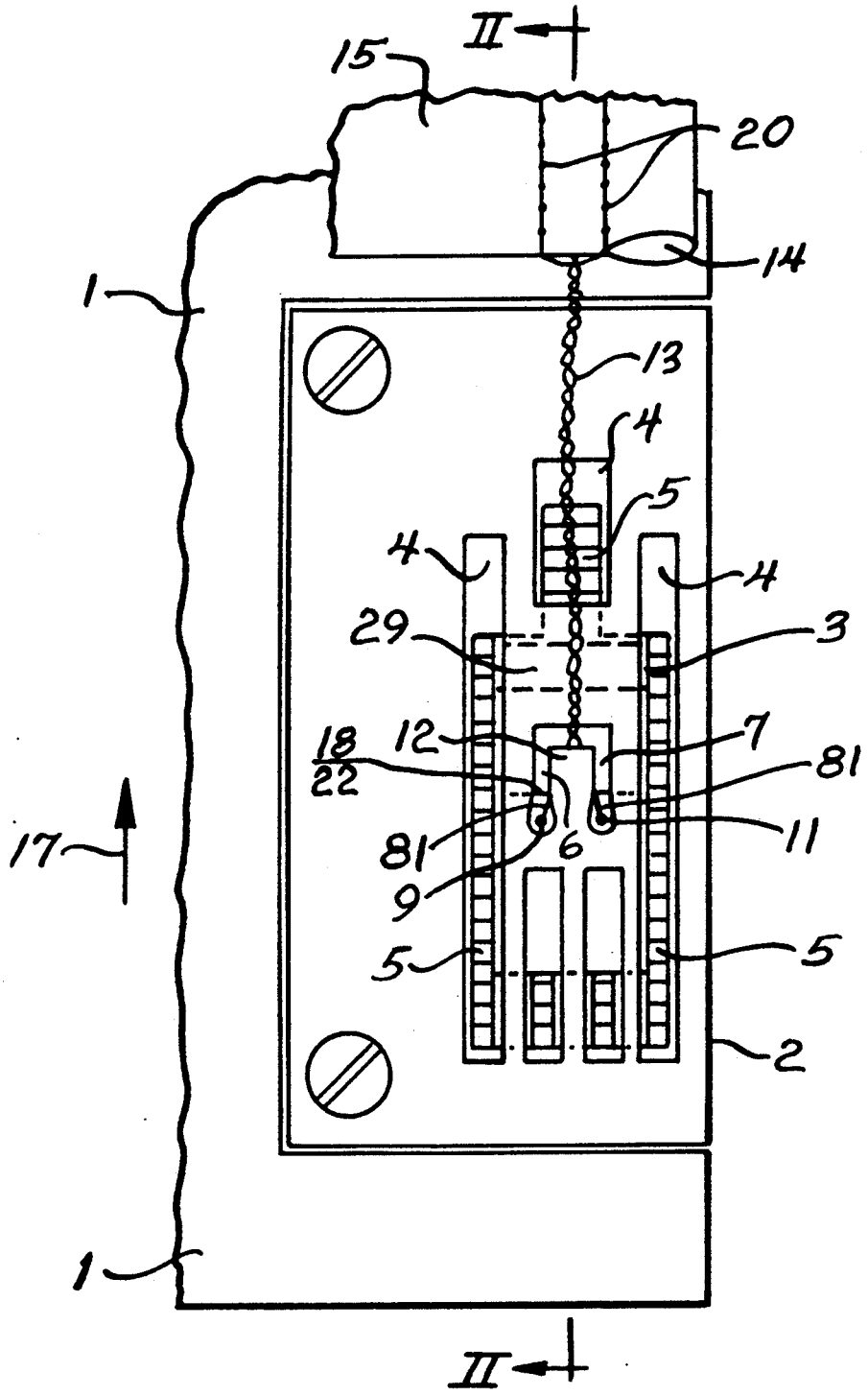
FIG. 1 is a fragmentary plan view of a chain-stitch forming device of the present invention showing the region of the stitch formation point with a workpiece sewn and the stitch chain extending therefrom.
Figure 2:
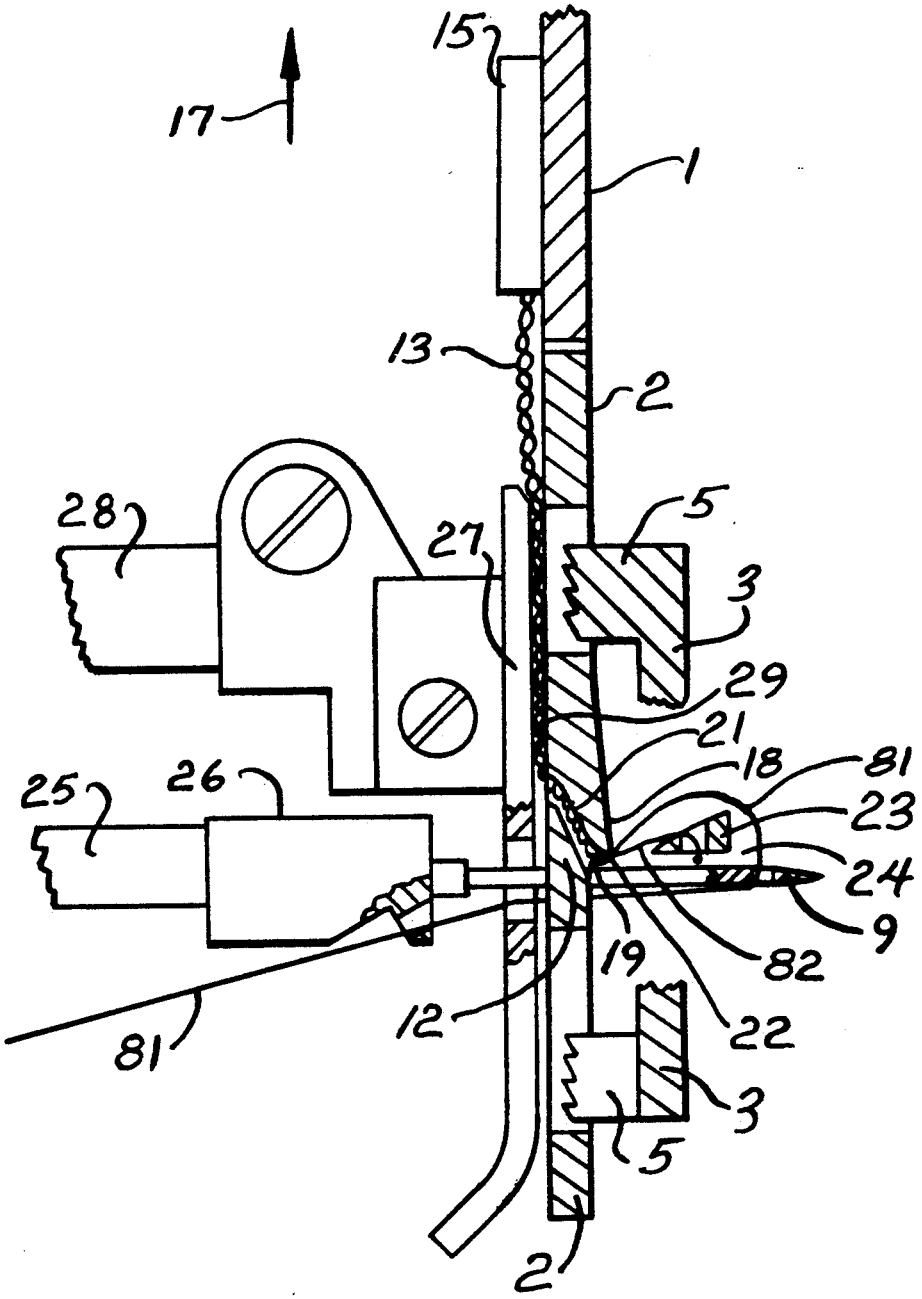
FIG. 2 is a fragmentary sectional view taken substantially as indicated along the line II—II of FIG. 1.

Referring now to FIGS. 1 and 2, there is shown a part of a sewing machine having a chain-stitch forming device with a workpiece support 1, a needle plate 2 and a feed dog 3. The needle plate 2 has slots 4 for the rows 5 of feed dog teeth. It is provided with needle hole slots 6 and 7, through which pass needles 9 and 11 carrying needle threads 81. A stitch formation tongue 12 is disposed between the needle hole slots 6 and 7.

The needle threads 81 form, together with a looper thread 82, as shown in FIG. 2, termed sewing threads below, a thread chain 13 which provides a seam 20 in a hem 14 of a workpiece 15, the seam 20 being of a suitable stitch type, such as stitch type 406. An arrow 17 shows the direction of travel of the workpiece 15.

As shown in FIG. 2, the sewing machine has a thread brake device 18. A support surface 21 having a deflecting edge 22, which runs substantially transversely with respect to the direction of sewing and at which the needle threads 81 and the looper thread 82 are deflected and hence braked and positioned, is disposed at a distance 19 underneath the stitch formation tongue 12 closely beyond the sewing needles 9 and 11 in the direction of sewing. At least three sewing threads 81 and 82, which are guided in the sewing needles 9 and 11 and in a reciprocatingly movable looper 23, are deflected, braked and positioned at the thread brake device 18 in such a way that, similarly to stitch formation with a workpiece 15, satisfactory stitch formation is possible even without a workpiece 15, such as, for example, in UNION SPECIAL Machine Class 34700KF12. During chaining without a workpiece 15, the loops of the needle threads 81 are fastened to one another by intertwisting and interlinking with loops of the looper thread 82, thus forming the thread chain 13.

The sewing thread brake device 18 serves as a substitute for the workpiece 15, which normally binds the sewing threads 81, 82 in such a way that exact stitch formation can take place. In doing so, the sewing thread brake device 18 ensures that, during stitch formation, the previously formed stitch is not pulled back. During the downward motion of the sewing needles 9, 11, because of the thread brake device 18, a thread triangle of the looper thread 82 is formed at the looper 23, into which the sewing needles 9 and 11 with the needle threads 81 pass and in doing so bind the needle thread loops on the back of the looper by means of the looper thread 82.

During the upward motion of the sewing needles 9, 11, needle thread loops 24 form, as shown in FIG. 2, on the thread brake device 18, which the looper 23 picks up to form the next stitch.

Hence stitch formation, which is normally formed with the aid of the workpiece 15, is achieved without a workpiece 15, since, on the one hand, the thread-carrying sewing needles 9, 11 pass into the looper thread loop and, on the other hand, the thread-carrying looper 23 picks up the needle thread loops 24, which corresponds to known stitch formation with a workpiece 15.

A needle bar 25, which is disposed in the sewing machine so that it can move up and down, has a needle head 26 which guides the sewing needles 9 and 11.

During the feed movement of the feed dog 3, which is part of the feed device, the thread chain 13 is urged by means of one of the rows 5 of the feed dog teeth against a presser foot or hold-down device 27 and is hence conveyed in the direction of sewing. The hold-down device 27 is secured to a presser rod 28 which is resiliently mounted in the sewing machine.

A clamping surface 29 on the needle plate 2 ensures that the thread chain 13 is held between the needle plate 2 and the hold-down device 27 when the feed dog 3 dips below the top surface of the needle plate 2, that is, when no feed is taking place. The clamping surface 29 is dimensioned such that several of the formed stitches of the thread chain 13 may be clamped together between the needle plate 2 and the hold-down device 27.

The needle plate 2 and the deflecting edge 22 of the thread brake device 18 are shown from below in FIG. 3.

Another embodiment of the thread brake device with the needle plate is shown in FIG. 4. In this embodiment, the thread brake device is also fastened on an underside of the needle plate 2 at a distance 19 from the stitch formation tongue 12. This thread brake device 18 is in the form of a cross pin 32, which is disposed substantially transversely to the direction of sewing.

As shown in FIG. 5, the cross pin 32 may have two possible cross sectional forms 33 and 34. Cross section 33 is circular and cross section 34 wedge-shaped, wherein the wedge is directed towards the sewing needles 9, 11. The wedge shape of the cross pin 32 strengthens the braking effect of the sewing thread brake device 18 on the sewing threads 81, 82 in comparison to the circular shape.

It is to be ensured that the needle thread brake device 18 generally speaking permits reliable stitch formation of a thread chain in multiple-needle chainstitch sewing machines which form a double chain stitch of the Class 400 type or an overlap chain stitch of the Class 600 type in accordance with DIN 61400, May 1988 Edition. The overlap chain stitch from Class 600 is formed substantially in that, in comparison to Class 400, a further overlap or cover thread, which is disposed in a loop-like manner, is bound by means of the needle threads 81.

It is also within the scope of the subject of the invention to dispose a separate sewing thread brake device 18 in the region of the stitch formation zone, which device is not a part of the needle plate 2, but which causes the same braking effect on the sewing thread 81, 82 through the same or a similar arrangement and formation.

The foregoing detailed description is given for clearness of understanding only, and no unnecessary limitations should be understood therefrom, as modifications will be obvious to those skilled in the art.

What is claimed is:

1. A device for forming a thread chain on a multiple-needle chainstitch sewing machine, having at least two sewing needles, a looper, a needle plate having at least two needle hole slots and a stitch formation tongue disposed between the needle slots, a feed device having a feed dog, a holding-down device, and a sewing thread brake device disposed below the stitch formation tongue beyond the sewing needles in the direction of sewing.

2. The device of claim 1 in which the sewing thread brake device comprises a support surface which is disposed at a distance from the stitch formation tongue and has a deflecting edge which extends substantially transversely with respect to the direction of sewing.

3. The device of claim 1 in which the sewing thread brake device comprises a cross pin which is disposed at a distance from the stitch formation tongue and is disposed substantially transversely to the direction of sewing.

4. The device of claim 1 in which the thread brake device is part of the needle plate.

* * * * *